United States Patent [19]

Pedtke et al.

[11] Patent Number: 4,764,755

[45] Date of Patent: Aug. 16, 1988

[54] INTRUDER DETECTION SYSTEM WITH FALSE-ALARM-MINIMIZING CIRCUITRY

[75] Inventors: Daniel F. Pedtke, Fairport; George E. Behlke, Farmington, both of N.Y.

[73] Assignee: Detection Systems, Inc., Fairport, N.Y.

[21] Appl. No.: 77,904

[22] Filed: Jul. 27, 1987

[51] Int. Cl.[4] ..... G08B 13/21

[52] U.S. Cl. ..... 340/541; 250/340; 340/529; 340/566; 340/567

[58] Field of Search ..... 340/567, 541, 587, 529, 340/566, 501; 250/340

[56] References Cited

U.S. PATENT DOCUMENTS

| | | | |
|---|---|---|---|
| 4,258,255 | 3/1981 | Guscott | 250/342 |
| 4,521,768 | 6/1985 | Haran et al. | 340/529 |
| 4,570,157 | 2/1986 | Kodaira | 340/567 |
| 4,612,442 | 9/1986 | Toshimichi | 340/557 |

*Primary Examiner*—Glen R. Swann, III
*Attorney, Agent, or Firm*—Warren W. Kurz

[57] ABSTRACT

An intruder detection system is provided with circuitry for reducing the risk of false alarms from spurious sources. Such circuitry comprises a pulse generator for producing current pulses of predetermined pulsewidth and amplitude each time the output of an intrusion detecting element exceeds or falls belows a preset threshold level, an integrating circuit for integrating the output of the pulse generator, threshold sensing means for activating an alarm when the integrator output exceeds a preset level, and a timing circuit for establishing a predetermined time interval and for discharging the integrating circuit in the event the integrator output fails to exceed such preset level within such predetermined time interval. According to a preferred embodiment, means are provided for resetting the time interval each time the detector output exceeds or falls below the selected threshold level. By selecting a relatively short time interval and by resetting such time interval every time a potential target is detected, certain types of spurious sources are prevented from producing false alarms.

4 Claims, 3 Drawing Sheets

REF. A
a
REF. B
P1
P2
P3 b c t
d t
H
M
L
e f
R
R
RESET
T
T
T

ALARM THRESHOLD
REF. C
g

INTRUDER DETECTION SYSTEM WITH FALSE-ALARM-MINIMIZING CIRCUITRY

BACKGROUND OF THE INVENTION

This invention relates to intruder detection systems and, more particularly, to improvements in signal processing for the purpose of minimizing any tendency for false alarms.

In U.S. Pat. No. 4,612,442 issued to Toshimichi, there is disclosed a passive infrared intrusion detection system comprising circuitry for processing digital signals to minimize the effects of spurious false-alarm-producing sources. Such circuitry includes a pulse width discriminator for eliminating so-called "popcorn" noise, and a digital counter for counting potential alarm-producing pulses produced by the infrared radiation-sensitive detector element of the system. Only in the event that a predetermined count is reached within a certain time interval (determined by a timing circuit) is an alarm relay activated.

In the above-mentioned intruder detection system, the time interval during which pulses are counted is initiated by the first pulse transmitted by the pulse discriminator. Once initiated, the time interval times out for the selected time period (usually about 20–30 seconds). If the requisite number of pulses is not counted during that period, no alarm is sounded, and the pulse that initiated the time interval, as well as those counted pulses which are less than the number required for alarm activation, are assumed to have been produced by something other than an intruder.

In order to assure that the above system will detect intruders at long range, the time interval must be sufficiently long as to allow a slow moving intruder to cross two target fields (i.e., two fields of view of the detector element). Obviously, if the time interval is set for a relatively long period, say, several minutes, spurious signals spaced minutes apart (not unusual) can produce false alarms. On the other hand, if the time interval is set relatively short, say, for only a few seconds, a slow moving intruder can go undetected. With these two consideratons in mind, a time interval of between 20 and 30 seconds is usually selected.

While the digital signal processing circuitry described in the above-mentioned Toshimichi patent may be effective in discriminating many false-alarm-producing events from those attributable to intrusion, such circuitry is nevertheless susceptible to certain types of spurious sources. For example, in the case of a passive infrared system of the type having extremely sensitive pyroelectric sensors, if a heater is turned on in the region under surveillance, the sensors can saturate, producing a first pulse at the outset of such event, and second and third pulses, perhaps 20 seconds later as the sensors come out of saturation and settle to a steady-state condition. Assuming the system is set to alarm after counting 3 pulses within a 25 second time window, such an event would give rise to a false alarm. Thus, it would be very desirable to shorten the time interval during which pulses are counted without sacrificing the "catch" performance at long range. Also, it would be desirable to reduce the cost of signal-processing circuitry of the above system (which requires a relatively costly digital counter) without sacrificing the effectiveness of such systems in minimizing false alarms.

SUMMARY OF THE INVENTION

In view of the foregoing, an object of this invention is to provide an intruder detection system of the type described which is even less susceptible to false alarm-producing sources.

Another object of this invention is to provide low-cost signal processing circuitry for intruder detection systems, circuitry which is improved from the standpoint that it requires no digital counter or pulse-width discriminating circuitry to achieve high reliability in rejecting spurious false-alarm-producing signals.

Like similar intruder detection systems, that of the invention comprises (a) a sensor for detecting the presence of an intruder in a region under surveillance, such sensor being adapted to produce a first signal which varies with respect to a nominal level in response to the presence of an intruder in such region, and (b) first threshold sensing means operatively coupled to the sensor for producing a second signal whose steady-state level changes each time the first signal exceeds or falls below a threshold level. Unlike the prior art systems, however, the intruder detection system of the invention is characterized by (c) pulse generating means for producing current pulses of predetermined pulsewidth each time the output of the threshold-sensing means changes level, (d) integrating means operatively coupled to the current pulse generator for integrating the current pulses and for producing a third signal porportional to the number of current pulses received, (e) second threshold sensing means for activating an alarm relay when the level of the third signal exceeds a preset level, and (f) timing means for discharging the integrator means a predetermined time period after the first current pulse is received by the integrator, such predetermined time period being reset each time a current pulse is produced by the pulse generator. Preferably, the current pulse amplitude and/or pulsewidth, is/are variable to control the sensitivity of the sytem.

The invention will be better understood from the ensuing detailed description of preferred embodiments, reference being made to the accompanying drawings.

DETAILED DESCRIPTION OF PREFERRED EMBODIMENTS

Figure 1:
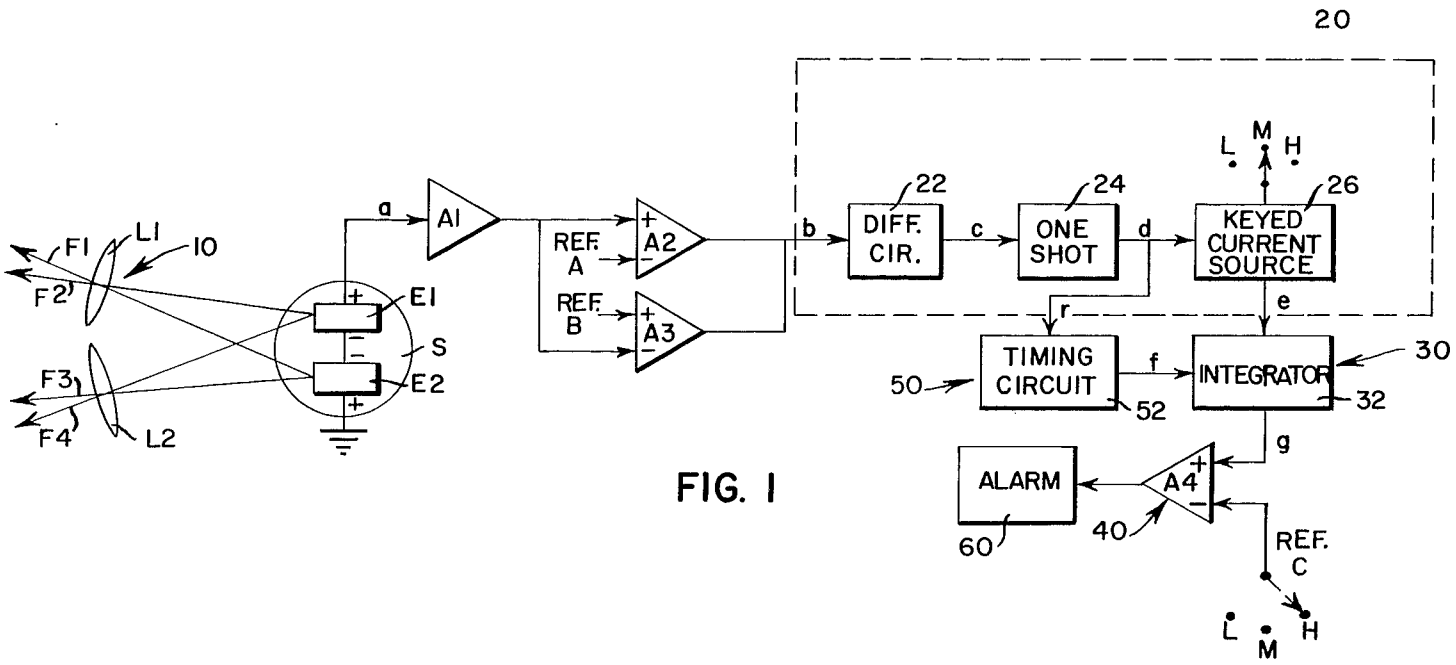
FIG. 1 is a block diagram of a passive IR intruder detection system embodying the invention.

Referring now to the drawings, the block diagram of FIG. 1 illustrates a passive infrared intruder detection system embodying the signal processing circuitry of the invention. Such system typically comprises a multifaceted optical system 10 shown for the sake of convenience as a pair of lenslets L1 and L2, for focusing infrared rediation (IR) onto a sensor S. Typically, the IR sensor comprises a pair of spaced pyroelectric elements E1, E2, each element cooperating with each facet of the optical system to provide the detection system with multiple, discrete fields of view, in this case fields F1–F4. Such sensor/multifacet optical system combinations are well known in this art and, hence, need not be described further herein. For further details, the reader may refer to the aforementioned U.S. Pat. No. 4,612,442, as well as to U.S. Pat. No. 4,258,255.

Figures 2A, 2B, 2C, 2D, 2E, 2F, 2G:
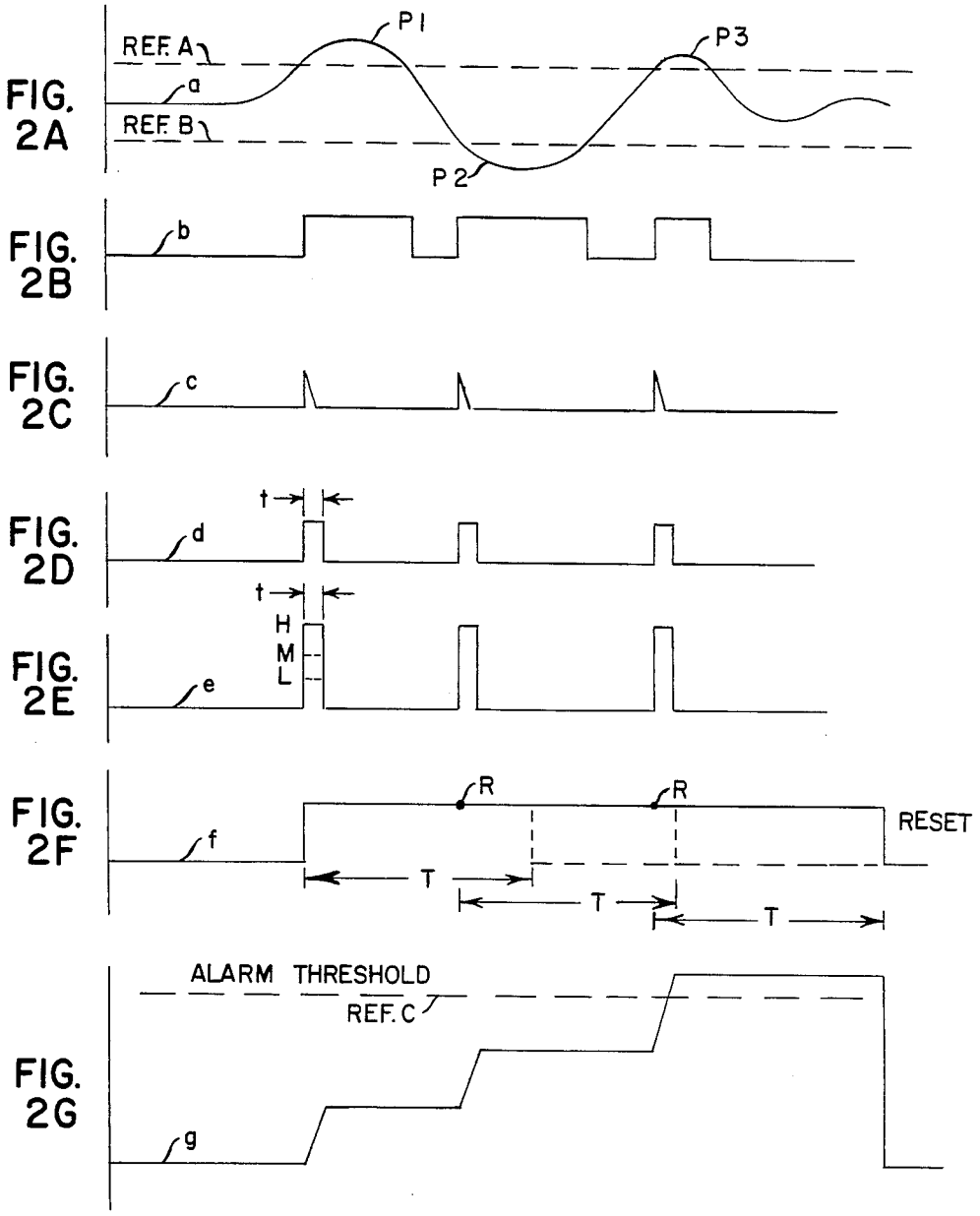
FIGS. 2A–2G illustrate the waveforms of the outputs of various components of the FIG. 1 system.

As shown in FIG. 1, the pyroelectric elements E1 and E2 are connected in series opposition. Thus, as an intruder passes through, say, fields F1 and F2 the pyroelectric elements produce a signal (as shown in FIG. 2A) comprising a first pulse P1 of a first polarity, followed by a second pulse P2 of opposite polarity. Also, a third pulse P3 is usually produced as the crystal lattice of the pyroelectric element restores to equilibrium. The output of senosr S is suitably amplified by a high gain bandpass amplifier A1, which filters out frequencies uncharacteristic of intrusion. The amplifier output is connected to the positive and negative inputs of a pair of differential amplifiers A2 and A3, respectively, which operate as comparators. The negative terminal of amplifier A2 is connected to positive reference voltage, REF. A, and the positive terminal of amplifier A3 is connected to a negative reference voltage, REF. B. Amplifiers A2 and A3 provide a threshold sensing function, assuring that the respective sensor element outputs exceed certain minimum levels (determined by the reference voltages) before the system will consider such outputs intruder-produced. The output b of amplifiers A2 and A3 will go positive whenever either the output of amplifier A1 is so positive that it exceeds REF. A, or is so negative that it exceeds the negative reference voltage REF. B. The output of amplifiers A2 and A3, for the input shown in FIG. 2A, is shown in FIG. 2B. So far, this type of signal processing is conventional in the art and is, for example, disclosed in the aforementioned U.S. Pat. No. 4,258,255.

The additional, false-alarm-discriminating, signal processing circuitry of the invention basically comprises the combination of current pulse generating means 20, integrating means 30, threshold sensing means 40 and timing means 50. Preferably, current pulse generating means 20 comprises a conventional differentiating circuit 22 which eliminates certain noise components present in the output of the threshold-sensing amplifiers A2 and A3. As shown in FIG. 2*c*, the output c of the differentiating circuit is in the form of a spike each time the output of amplifiers A2 and A3 goes positive. This occurs, of course, each time the sensor output a breaks out of the voltage range defined by the threshold levels of REFS. A and B. The output of differentiater 22 triggers a conventional one-shot (multivibrator) 24 which, when triggered, provides a pulse of predetermined pulse width t. The one-shot output d serves the dual function of initiating (or resetting) a timing signal f provided by the timing circuit 50, and of keying a current source 26 to produce a current pulse of the same pulsewidth as the one-shot output. The amplitude of the pulse produced by the current pulse generator is adjustable to provide a means for adjusting the system sensitivity. The output e of the current pulse generator is integrated by integrating means 30 which may comprise a conventional timing circuit 32, and the integrated output g thereof serves as one input to threshold-sensing means 40. The latter may take the form of a differential amplifier A4. When the integrator output exceeds an alarm threshold determined by the other input of the threshold sensor, i.e. REF. C, an alarm relay 60 is energized. If, however, the alarm threshold is not exceeded by the integrator output within a time interval defined by a timing signal f provided by the timing circuit 52, the charge on the integrator is dumped, i.e., dischargd to ground. The output of the timing circuit is in the form of a pulse of nominal pulsewidth T. The pulsewidth T is, of course, adjustable, being determined by the selected parameters of the particular circuit elements comprising timing circuit 52. This pulse establishes a time window during which, as noted above, the integator output must exceed a certain threshold for alarm activation. A particularly important aspect of this invention is that the time window is reset to zero time at time R whenever a current pulse is received by the timing circuit from the current pulse generator, as shown in FIG. 2F. By this arrangement, as explained below, certain types of false alarms can be avoided. The advantageous effect of the signal processing cicuitry of the invention is illustrated in FIGS. 3A–3D.

Figure 3A:
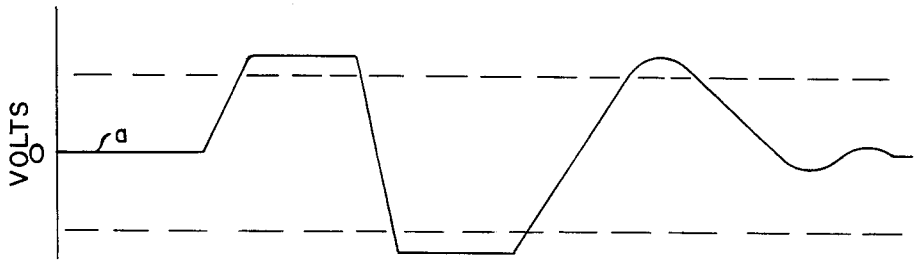
FIGS. 3A–3D illustrate the effectiveness of the invention in discriminating against one type of spurious source.
Figure 3B:
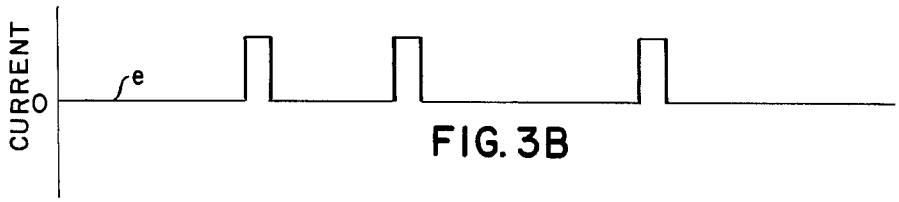
Figure 3C:
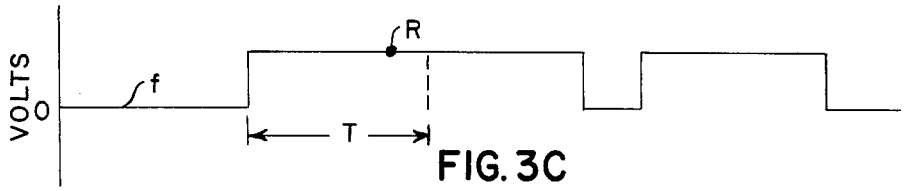
Figure 3D:
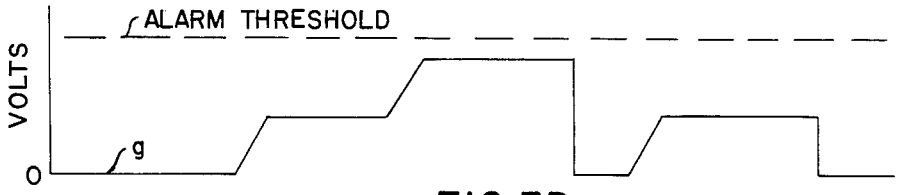

Referring now to FIGS. 3A–3D, the output a of the threshold-sensing amplifiers A2 and A3 is shown as it would be in the event of the sensor elements detect an abrupt increase in radiation in this respective fields of view. As mentioned earlier, such an event might be occassioned by a room heater being switched on by a thermostat. It might also be caused by sunlight being momentarily reflected directly onto the sensor package. In any such event, the relatively intense and sudden increase in ambient IR will cause the sensor output to saturate. Such saturation is commonly exemplified by the waveform shown in FIG. 3A. In response to this waveform, the keyed current pulse generator comprising signal processing circuitry of the invention will produce three current pulses on output e, such pulses being spaced in time as shown in FIG. 3B. Responsive to these pulses, timing circuit 50 will produce the timing signal f shown in FIG. 3C. As shown, timing pulse P1 initiates the nominal time period T during which the integrator can accumulate charge from the applied current pulses. Assuming that period T is selected for, say, five seconds, and the time spacings between pulses P1 and P2, and between P2 and P3 are four and seven seconds, respectively, then the integrater output will be as shown in FIG. 3D. As is apparent, pulse P2 is effective to reset the period T at t=R. This has the effect of prolonging the period during which the integrater can accumulate charge to nine seconds. But, pulse P3 comes too late to reset and thereby further prolong this time interval. Thus, at the end of nine seconds, the integrator is discharged and its output returns to zero. The arrival of pulse P3 intitiates a new time period T which, as shown, times out after the nominal five second period since no further pulses are received within the period.

From the foregoing, it should be apparent that the signal processing circuitry of the invention is capable of discriminating against certain false alarm sources to which the aforementioned prior art systems are susceptible. Note, since the prior art systems do not reset the timing period on each pulse, i.e. each time the sensor output breaks above or below the threshold level, such systems requires that period T be set relatively long and, when so set, such systems are susceptible to the aforedescribed spurious sources.

The sensitivity of the detection system described above can be readily changed by either controlling the amplitude of the current pulses or by controlling the value of REF. C. Either (or both) approach can be used to control the number of current pulses required to reach the alarm threshold.

While the invention has been described with reference to a preferred embodiment, obvious variations will suggest themselves to skilled artisans and such variations are intended to be within the scope of the following claims.

We claim:

1. An intruder detection system comprising:

(a) sensing means for sensing the presence of an intruder in a region under surveillance, said sensing means being adapted to produce a first output signal which changes in level in response to the presence of an intruder in such region;

(b) pulse generating means for producing pulses of current each time said first output signal exceeds or falls below a preset threshold level;

(c) integrating means, operatively coupled to said pulse generating means, for integrating said current pulses and for providing a second output signal representative of the integrated value of such pulses;

(d) threshold sensing means for producing an alarm signal in the event said second output signal exceeds a predetermined level; and (e) timing circuit means for discharging said integrating means in the event said second output signal fails to exceed said predetermined level within a preselected time interval, said time interval being reset (i.e. re-established) each time said first output signal exceeds or falls below said preset threshold level.

2. The invention as defined in claim 1 wherein said pulses of current have a predetermined amplitude and pulsewidth, and wherein the amplitude and/or the pulsewidth of said current pulses is adjustable to control the number of current pulses required for said second output signal to exceed said predetermined level.

3. The invention as defined by claim 1 wherein said time interval is adjustable to control the system sensitivity.

4. The invention as defined by claim 1 wherein said predetermined level of said threshold sensing means is adjustable to vary the system sensitivity.

* * * * *